United States Patent [19]

Waring

[11] Patent Number: 4,655,638

[45] Date of Patent: Apr. 7, 1987

[54] WATERSTOP FOR MONOLITH JOINTS AND METHOD

[75] Inventor: Stephen T. Waring, Kent, Wash.

[73] Assignee: Gelco Grouting Service, Oreg.

[21] Appl. No.: 873,783

[22] Filed: Jun. 12, 1986

[51] Int. Cl.[4] ..... E02B 3/10

[52] U.S. Cl. ..... 405/107; 405/152

[58] Field of Search ..... 405/108–114, 405/150, 151, 152; 156/156, 287; 138/97; 29/421 R; 254/134.4

[56] References Cited

U.S. PATENT DOCUMENTS

| | | | |
|---|---|---|---|
| 2,277,286 | 3/1942 | Bechtner | 405/107 |
| 2,333,826 | 11/1943 | Smith et al. | 405/152 X |
| 2,794,758 | 6/1957 | Harper et al. | 405/154 X |
| 4,009,063 | 2/1977 | Wood | 156/71 |
| 4,064,211 | 12/1977 | Wood | 264/95 |
| 4,135,958 | 1/1979 | Wood | 29/421 R |
| 4,202,531 | 5/1980 | Hamrick | 254/134.4 |
| 4,456,401 | 6/1984 | Williams | 405/146 X |
| 4,581,085 | 4/1986 | Wood | 138/97 X |
| 4,602,974 | 7/1986 | Wood et al. | 156/287 |

FOREIGN PATENT DOCUMENTS

| | | | |
|---|---|---|---|
| 1079091 | 4/1960 | Fed. Rep. of Germany | 405/152 |

*Primary Examiner*—Dennis L. Taylor
*Attorney, Agent, or Firm*—Eugene M. Eckelman

[57] ABSTRACT

A tubular member is arranged to be inserted in a hole drilled in adjacent monoliths astraddle a joint between the monoliths. The tubular member comprises an outer layer of material saturated with a resin capable of bonding to defining walls of the hole. An inner layer of fluid impermeable material is bonded to the outer layer of the tubular member. When installed in a drilled hole, the tube is placed with the resin saturated layer against and in bonding relation with the wall of the hole. A core portion may be placed in the tube to hold it in tight bonded engagement with the hole, such core portion comprising a flexible filler such as grout having an elasticity which when cured flexes with differential movements of adjacent monoliths. The tubular member has two or more barriers therein which prevent the saturating resin from washing away during installation.

5 Claims, 8 Drawing Figures

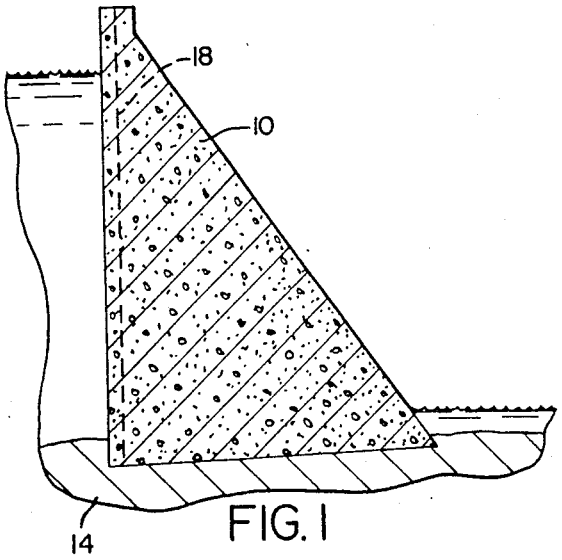
FIG. 1
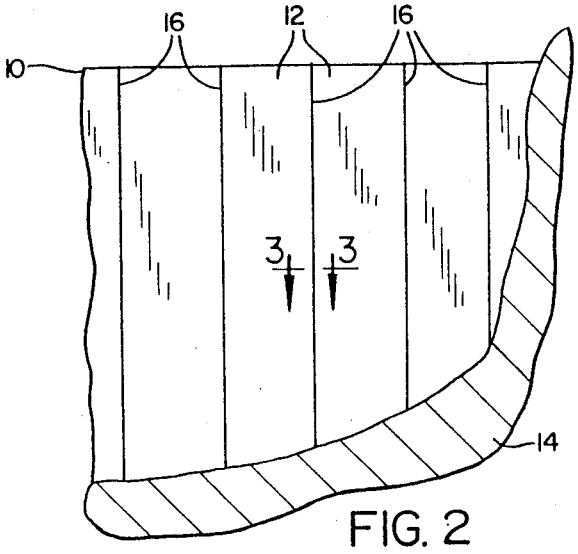
FIG. 2
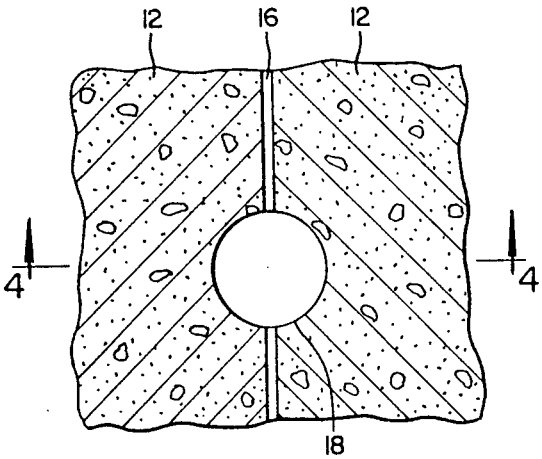
FIG. 3
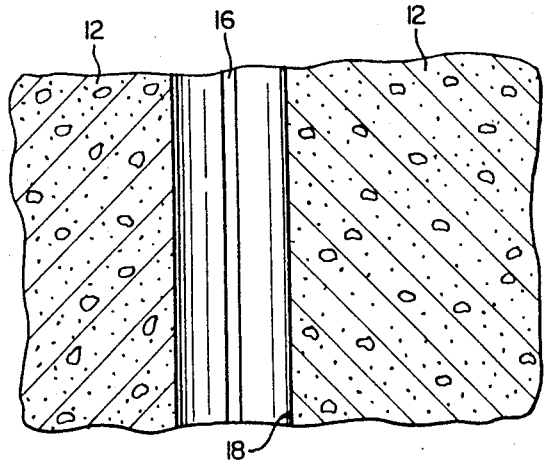
FIG. 4
FIG. 5
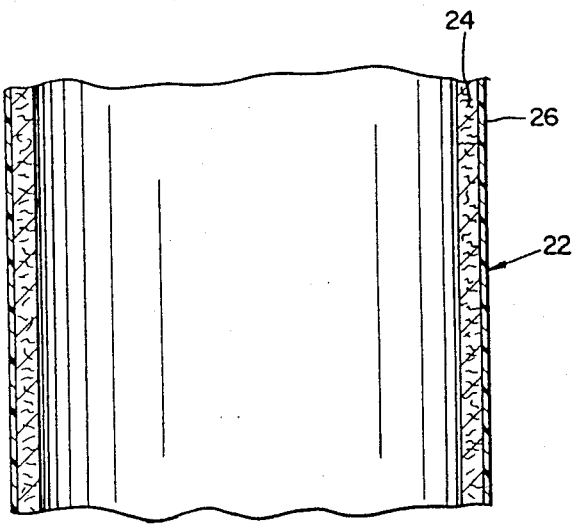

WATERSTOP FOR MONOLITH JOINTS AND METHOD

This invention relates to new and useful improvements in a waterstop for monolith joints and to a method of forming the waterstops.

BACKGROUND OF THE INVENTION

Monolith joint waterstops are necessary in dams, power houses, navigation locks, and other structures, and these waterstops have been of several structures. In many instances, adjacent monoliths have different foundation support which may cause relative movement between these monoliths. Also, seasonal climatic changes can open and close the joints due to thermal expansion and contraction. Varying hydraulic loading conditions also effect movement. The joints must remain free to accommodate these movements. A common type of waterstop comprises embedded copper plates with a fold along the joint. More recently, embedded polyvinyl-chloride waterstops have been used which are inserted in vertical holes cut in straddling relation to the joint between the monoliths. Other types of waterstops have also been provided but in general all of the prior structures do not possess a combination of desired features, namely, a structure which makes them readily installable, including installation under water pressure conditions, which provides an effective seal, which accommodates relative movement between adjacent monoliths, which is long lasting and which is capable of being readily repaired or replaced. Remedial waterstops heretofore installed have not performed satisfactorily, not only for the same reasons surrounding the circumstances of installation, but for material failure as well.

SUMMARY OF THE INVENTION

According to the present invention and forming a primary objective thereof, a waterstop for monolith joints is provided which is readily installable, including installation under water pressure conditions, which provides an effective seal, which accommodates relative movement between adjacent monoliths, which is long lasting in service, and which can be repaired or replaced if necessary.

Another object is to provide a method of constructing the waterstop of the invention.

These objectives were achieved in structure shown and described in my earlier co-pending application Ser. No. 650,233, now U.S. Pat. No. 4,626,133. The present application is concerned with further improvements in this type of waterstop.

In carrying out these objectives and improvements, a vertical hole is made down the joint between adjacent monoliths and has a radial dimension such that the hole extends on each side of or straddles the joint. The present waterstop is formed by a long, continuous, strong but flexible tube of carrier material which is impregnated with an adhesive-type, flexible and water-reactive resin and which is inserted in the hole. The tube has a layer of fluid impermeable plastic bonded to the carrier material. In the installation of the tube in the cut hole, the tube with the carrier material for the resin material as the outside layer is saturated with the resin and then forced into the cut hole. The fluid impermeable plastic layer is on the inside of the tube and the resin saturated carrier, being on the outside, bonds to defining walls of the hole. The resin saturated carrier tube has one or more longitudinal barriers of water impermeable material therein which prevents head water from washing resin out of the joint. Sealing expansion of the tube against the walls of the hole is provided by suitable pressure within the tube and with the tube fully installed in the hole, it may have a filler inserted therein if necessary to hold the impregnated felt tight against the wall of the hole for curing.

The invention will be better understood and additional objects and advantages will become apparent from the following description taken in connection with the accompanying drawings.

BRIEF DESCRIPTION OF THE DRAWINGS

FIG. 1 is a diagrammatic side elevational view of a dam for illustrating an exemplary monolith structure with which the instant invention may be used;

FIG. 2 is a diagrammatic view of a face portion of the dam taken from the left of FIG. 1;

FIG. 3 is an enlarged fragmentary sectional view taken on the line 3—3 of FIG. 2 and showing an initial step of the invention wherein a hole is made between adjacent monoliths;

FIG.4 is a sectional view taken on the line 4—4 of FIG. 3;

FIG. 5 is an enlarged fragmentary sectional view showing the structure of a tube member which in a subsequent step is installed in the hole between monoliths;

DETAILED DESCRIPTION OF PREFERRED EMBODIMENTS

Reference is first made to FIGS. 1 and 2 which show conventional monolith structure. The structure illustrated comprises a dam 10 formed of adjacent monoliths 12. The monoliths are seated on bedrock 14 and separated by vertical joints 16, also seen in FIGS. 3 and 4. These joints are provided with suitable waterstops, not shown, which have failed and leakage occurs through the joints to be repaired.

Figure 7:
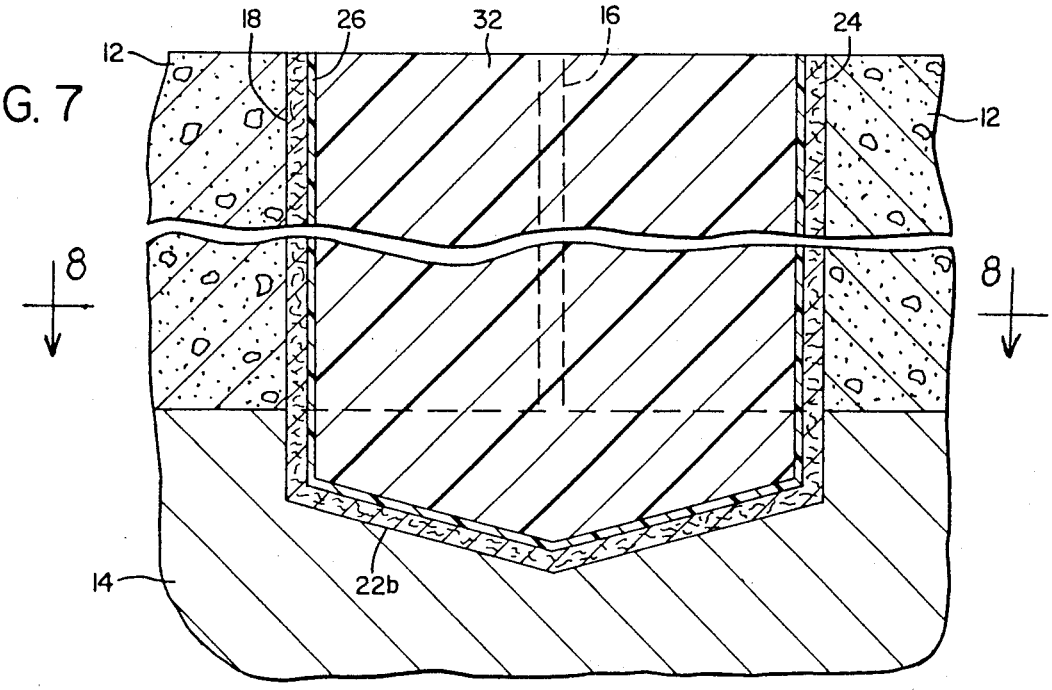
FIG. 7 is an enlarged sectional view also taken similar to FIG. 4 showing the installed tube and a filler therein.

FIG. 3 shows a first step of constructing the present waterstop. Such comprises drilling a hole 18 in straddling relation to the joint 16. This hole is drilled to the desired diameter and to the desired depth such as to a point below the leak or fully down into bedrock 14 if desired, as seen in FIG. 7.

In connection with the invention, a long, continuous, strong but flexible tube 22 or liner is utilized for placement in the hole 18 in a manner later to be described. With particular reference to FIG. 5, this tube comprises a carrier layer 24 for a water reactive resin. This layer is integrated with a thin layer 26 of fluid impermeable material such as plastic. The resin carrier layer 24 may be made up of a single layer of material or multiple layers. It may be formed into tubular form from flat material by suitable joining of edge portions, as by stitching, followed by a sealing closure strip over the stitches.

In the process of installing the present water stop, the layer 24 is first saturated with resin. With reference to FIG. 7, the tube is then installed in the drilled hole 18 with the layer 24 as the exterior layer for secured attachment of the resin to the walls of the hole. The tube has a closed bottom end 22*b*. The method of installation of the tube in the drilled hole may vary but a preferred form is to use an inversion method. Such an inversion method is carried out with the tube 22 in its FIG. 5 form, namely, the layer 24 is on the interior of the tube and the layer 26 is on the exterior. For saturating the layer 24, it is preferred that drying medium such as hot air be first blown through the tube and then resin pumped into the tube and the latter drawn through pinch rollers which force the resin throughout the length of the tube to thoroughly saturate the layer 24. Impregnation of the resin into the layer 24 may also be by a vacuum method. The fluid impermeable layer 26 comprises the container for the resin during this process.

Figure 6:
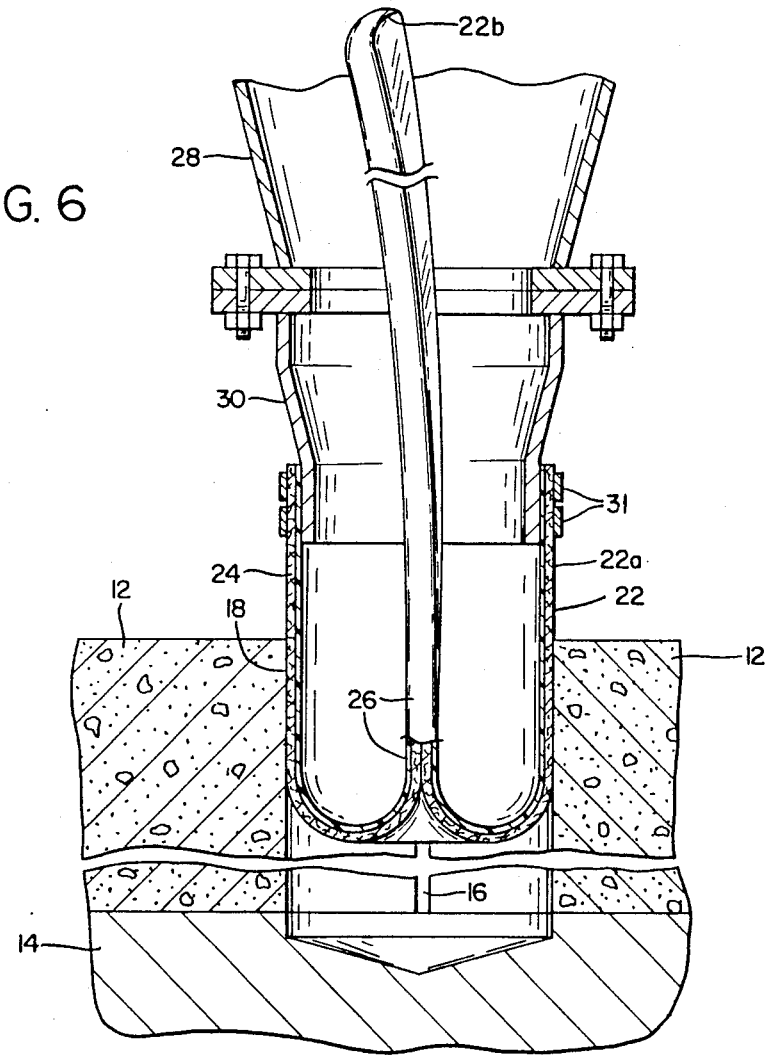
FIG. 6 is a sectional view taken similar to FIG. 4 and showing apparatus and process for inverting the tube of FIG. 5 in the cut hole made between monoliths.

With the hole 18 properly cleaned and inspected by conventional closed circuit camera means and the tube saturated with resin, the tube can be installed in the hole by inverting apparatus 28, FIG. 6, having a hollow nozzle portion 30 through which the tube 22 extends. One end 22*a* of the tube is doubled back and secured, as by bands 31, to the nozzle 30 of the inverting apparatus. The end portion 22*a* will comprise the top of the tube in its installed position. The closed end 22*b* of the tube, FIG. 7, will comprise the bottom end when installed. Prior to installation using the inversion method, the tube is preselected in length so that the closed end 22*b* will bottom out at the proper distance in the hole. During installation, the bottom end will disappear down the hole at about the half-way point of installation. As stated, the hole 18 extends the desired depth in the monolith portions and may extend into bedrock if desired, FIG. 7.

The inverting apparatus 28 utilizes pressured fluid through the nozzle 30 whereby with the end 22*a* of the tube 22 attached to the apparatus, pressured fluid is utilized to turn the tube inside out. This pressured fluid may comprise liquid or gas. As the tube turns inside out and progresses down the hole, it is maintained full of fluid, and with suitable pressure therein, including head pressure if a liquid such as water is used as the inverting fluid, the resin in the layer 24 will be pressed against and bonded securely to the walls of the hole. If a gaseous form is used as the inverting medium, it is admitted under suitable inverting pressure which also is used to press the layer against the walls of the hole. Inspection by closed circuit camera means can also be made at this time to inspect positioning of the tube.

In the installed position of the tube 22, FIG. 7, the layer 26 is directed inwardly. The tube preferably is then filled with a filler capable of maintaining the tube fully expanded against all portions of the hole. This may comprise a non-gaseous fluid such as hydrated Bentonite, fluidized sand, etc. Preferably, the filler comprises an elastic chemical grout gel 32 having a density greater than water. This filler can be installed immediately after the tube is inserted or after some cure time of the resin. Since the density of the grout 32 is greater than water, it will displace water when poured in without added pressure. If a gaseous form is used to invert the tube, its pressure merely is released as the grout filling is placed in the tube. The filler 32 forms a core portion and maintains the resin of layer 22 in constant pressure bonded relation with the monolith. Since it is an elastic grout, it can flex and move with any relative movement of the monoliths.

The layer 24 may comprise any suitable carrier of resin absorbent material. An excellent material for this purpose comprises polyester needle felt. Representative thicknesses comprise between 3 and 7 mm. and the fineness of the felt for effective saturation is around 6 denier.

The resin used for saturating the layer 24 comprises a water reactive resin designed for sealing cracks and joints. When cured, it is desired that the resin form a dense structure with good tensile strength and good bonding to concrete. Also, the cured resin must be flexible to resist degradation through thermal expansion and contraction as well as wet and dry cycles and freeze and thaw cycles for long periods of time. It is also desirable that the resin have good resistance to attack by fungi, acids, alkalies and gases normally found in soil and commercial structures. Such resins are available on the market as concrete crack and joint sealants, a representative resin comprising that available from Avanti International under the trade name AV-220 Hydracure Injection Resin.

In the use of the desired resin in the layer 24 in combination with felt, the latter serves as reinforcement for the resin when the resin is set. Also, the felt will catch silt that may exist in head water leaking in the joint during installation and such silt may form a barrier whereby to decrease or close off the leak.

The layer 26 may comprise an available polyurethane film which has the known characteristics of being fluid impermeable and capable of being bonded to the felt layer. Its thickness approximates 20 mils and can be bonded to the layer 24 in any suitable manner such as by spraying.

The filler 32 comprises a suitable elastic chemical grout gel such as acrylamide grout mixture. If necessary, the specific gravity thereof may be increased by Celite or by the use of glycerine and/or ethylene glycol. It is necessary that this grout have characteristics of elasticity sufficient to distribute shear stress caused by the strain of differential movement between monoliths to maintain a high degree of lateral pressure. Also, it preferably is sufficiently viscous to compress under its own weight. This resin must also serve as a secondary waterstop in itself should the felt fail.

The elasticity of the tube when installed will fill in all irregularities in the hole. That is, the holes when bored may have rough spots, cavities or the like but these irregularities will be covered and sealed by the flexibility of the tube in its conformance to the interior shape of the hole. The layer 24 protects the layer 26 from being pierced by sharp edges. Also, there will be free or excess resin from the layer 24 due to the compression of this layer during installation, and this free resin will also fill irregularities in the hole. The forced application of the tube 24 into the hole can be readily carried on with head water running through the joint.

Figure 8:
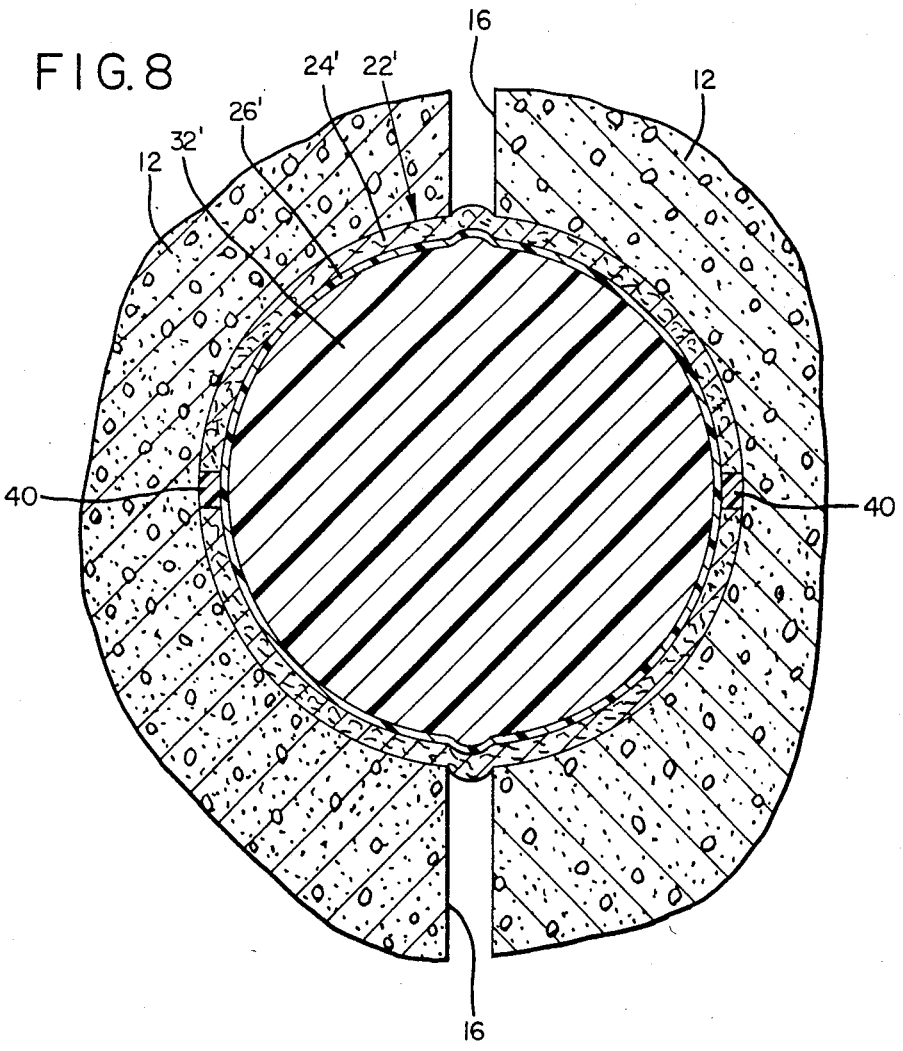
FIG. 8 is a sectional view taken on the line 8—8 of FIG. 7 and showing a detail of structure of the invention.

With reference to FIG. 8, an embodiment is illustrated which also uses a tube or liner 22' similarly employing an outer resin saturated layer 24' and an inner liquid impermeable layer 26'. In this embodiment, however, the felt in layer 24' is saturated at two or more points with resin barriers 40. More particularly, these barriers of resin are embedded in the felt in a time element such that they set up prior to installation of the tube in the hole. The resin of the barriers comprises a water impermeable and water insoluble material which is flexible when set and may consist of the same material as the saturating resin in the carrier 24 but of course first installed and set up prior to impregnation of the overall felt; or if desired the tube can comprise a manufactured product with the barriers formed therein. The resin in the barriers also must have a sufficient flexibility to allow inversion of the tube in the event that the inversion method of installation is used.

The barrier strips 40 extend the full length of the tube and prevent the resin in the felt from washing or extruding away from water pressure during installation. That is, some of the resin in the tube may wash around to a joint 16 due to pressure of head water and be lost. Barriers 40 prevents this escape of the resin. The FIG. 8 embodiment may also use an inner filler 32'.

According to the invention, a waterstop is provided that is readily installable, including installation under water pressure conditions which may exist from leakage. The waterstop provides an effective seal and readily accommodates differential movement between monoliths. Although it is intended primarily for remedial purposes, it can also be used as an original waterstop.

The present waterstop has a long life and can be replaced if necessary. The tensile strength of the tube, comprised of the layer 24 and its resin, and by the layer 26, is sufficient to allow the tube to be pulled out physically by unpeeling it from the wall of the hole. If small chunks of concrete are stuck to the tube upon removal of the tube, the cavities formed by these chunks are filled by resin and saturated felt forming a part of a renewing tube.

It is to be understood that the form of my invention herein shown and described is to be taken as a preferred example of the same and that various changes in the shape, size and arrangement of parts and type of materials may be resorted to without departing from the spirit of my invention, or the scope of the subjoined claims. For example, although the above structure illustrates the use of a round hole, such hole can be of other shapes. Also, the hole could pre-exist and it may not be necessary to drill one.

Having thus described my invention, I claim:

1. A waterstop for sealing a vertical joint between monoliths comprising an elongated tubular member arranged to be inserted in a hole provided in adjacent monoliths astraddle a joint therebetween, said tubular member comprising an outer layer of material saturated with a resin capable of bonding to defining walls in the hole, an inner layer of fluid impermeable material bonded to said outer layer, and one or more longitudinal barriers of water impermeable material preventing head water from washing said resin out of the joint during installation.

2. The waterstop of claim 1 wherein said longitudinal barrier is flexible to allow inversion of said tube into a hole.

3. The waterstop of claim 1 including a pair of said barriers, said barriers being located approximately in diametric relation in said tubular member and arranged to be disposed in spaced relation from the joint.

4. The waterstop of claim 1 including a flexible core portion filling the interior of said tube to maintain the tubular member in tight bonded engagement with the defining walls of the hole against head pressure acting on the monoliths.

5. The method of forming a waterstop in a vertical hole cut in adjacent monoliths astraddle a joint therebetween comprising the steps of lining the hole with a tubular member having a first layer saturated with a water reactive resin for bonding to defining walls of the hole and a second layer of fluid impermeable material bonded to said first layer, said tubular member having one or more longitudinal barriers of water impermeable material preventing head water from washing said resin out of the joint during installation, and positioning said tubular member in the hole such that said barriers are disposed in spaced relation from the joint.

* * * * *